US006921147B2

(12) United States Patent
Mitarai et al.

(10) Patent No.: US 6,921,147 B2
(45) Date of Patent: Jul. 26, 2005

(54) PRINTING APPARATUS

(75) Inventors: Reiji Mitarai, Tokyo (JP); Haruhiko Tanami, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 6 days.

(21) Appl. No.: 10/418,147

(22) Filed: Apr. 18, 2003

(65) Prior Publication Data

US 2003/0206212 A1 Nov. 6, 2003

(30) Foreign Application Priority Data

May 1, 2002 (JP) ..... 2002-129693

(51) Int. Cl.[7] ..... B41J 23/00; B41J 19/30
(52) U.S. Cl. ..... 347/37; 400/322
(58) Field of Search ..... 347/37, 38, 49; 400/320, 321, 322, 323; 310/112, 114; 318/696, 112; 327/108, 110

(56) References Cited

U.S. PATENT DOCUMENTS 3,942,619 A * 3/1976 Nordstrom et al. ..... 400/322
4,288,168 A * 9/1981 Mayr et al. ..... 400/322
4,775,945 A * 10/1988 Cavill et al. ..... 358/1.5
6,275,092 B1 * 8/2001 Maggio et al. ..... 327/424
6,337,587 B2 * 1/2002 Kruecke ..... 327/112

* cited by examiner

*Primary Examiner*—Anh T. N. Vo
(74) *Attorney, Agent, or Firm*—Fitzpatrick, Cella, Harper & Scinto

(57) ABSTRACT

A recording apparatus can improve stability of the speed of a carriage without increasing the production cost. The recording apparatus for performing recording by discharging ink from a recording device onto a recording medium includes a carriage adapted to convey a recording head, and a conveying member adapted to drive the carriage using a belt stretched between pulleys connected to corresponding ones of two motors. A driving force for the carriage by the two motors is differently distributed.

11 Claims, 8 Drawing Sheets

TOP PLAN VIEW

SIDE VIEW

FIG.6

| | FORWARD | BACKWARD | BRAKE |
|---|---|---|---|
| Tr1 | ON | OFF | ON |
| Tr2 | OFF | ON | OFF |
| Tr3 | OFF | ON | ON |
| Tr4 | ON | OFF | OFF |

PRINTING APPARATUS

BACKGROUND OF THE INVENTION

1. Field of the Invention

The present invention relates to an ink-jet recording apparatus for performing recording by discharging ink from recording means onto a recording material. More particularly, the invention relates to a technique for recording an image, such as a photograph image or the like, with high picture quality, and shortening the recording processing time.

2. Description of the Related Art

FIG. 7 is a schematic diagram illustrating a typical conventional technique in which a recording head is mounted and is caused to perform scanning with respect to recording paper, serving as a recording medium.

A carriage 1 for mounting a recording head is fixed to a timing belt 2 for transmitting a driving force to the carriage 1, by a holder 3. The timing belt 2 is tightly stretched between pulleys 4*a* and 4*b*, provided at both ends of the timing belt 2. A motor 5, serving as a driving source, is connected to one of the pulleys 4*a* and 4*b*. In FIG. 7, the pulley 4*a* and the motor 5 are coaxially connected.

The two pulleys 4*a* and 4*b* are not necessarily identical. Usually, the radii of the pulleys 4*a* and 4*b* are determined by the torque characteristics and the velocity characteristics of the motor 5. The idle pulley 4*b* is used together with a tensioner (not shown) for preventing sag of the timing belt 2, and comprises a member having relatively small inertia. An essential characteristic of this conventional system is one-side driving.

When driving the carriage 1 in a main scanning direction with such a configuration, it is clear that unsymmetrical thrust transmission is performed in a reciprocating operation. This can be simply explained as a difference whether the driving pulley 4*a* tracts the carriage 1 directly without using the idle pulley 4*b*, or indirectly via the idle pulley 4*b*. When performing two-way recording (reciprocating recording), a difference in the elongation property of the timing belt 2 will cause a problem. In addition to a difference in traction of the carriage 1 due to a reciprocating operation, a difference in easiness to induce vibration due to the tension of the timing belt 2 caused by the above-described difference also appears, thereby influencing the result of recording as variations in the speed during carriage scanning. Such variations in the speed will mostly cause stripe-shaped unevenness in the sheet feeding direction in a certain image.

In general, when driving a mass, such as a carriage or the like, according to belt connection, a force directly applied to the mass is the tension of the belt. FIG. 8 illustrates the relationship among tensions applied in the above-described system. The tension between the driving pulley 4*a* and the carriage 1 is represented by Ta, the tension between the carriage 1 and the idle pulley 4*b* is represented by Tb, and the tension between the two pulleys is represented by Tc. The position and the direction of each force are indicated by an arrow.

The particularity of a tension is in that the tension has a value of zero or a positive value, i.e., does not have a negative value, and the direction of the force is always constant. In other words, the belt can only pull and cannot transmit a pushing force. The equation of motion of the rigid body of the carriage 1 is determined by the difference between Ta and Tb, and represents acceleration in a dominant direction. If it is assumed that FIG. 8 represents a transient state in which the carriage 1 is accelerated to the right, by revolution of the motor in a counterclockwise direction, the tension increases in the order of Tc and Tb, and, at the same time, Ta decreases. Attention must be paid in that, since transmission of a force from Tc to Tb is slightly delayed, the carriage 1 is first accelerated due to sag of Ta. On the other hand, when the carriage 1 is accelerated to the left, thrust is directly transmitted by the tension Ta.

The sag of the tension is transmitted from Tc to Ta in a delayed state, and interferes with the tendency to increase the tension due to the leftward movement of the carriage. That is, the belt tension Tb between the carriage 1 and the idle pulley 4*b* has an essential property to induce vibration at a portion where Ta and a colliding action from Tc conflict. FIG. 9 illustrates an example of vibration during acceleration of the carriage 1. Although a large pulsation during acceleration is illustrated in order to facilitate understanding, fine vibration is generated even during constant-speed scanning, thereby causing degradation in the picture quality.

As described above, in the main-scanning driving system of the conventional recording apparatus, since the characteristics of speed control differ in a reciprocating operation, it is difficult to perform high-quality recording in two-way scanning. Furthermore, since the belt tension greatly fluctuates and is directly influenced by pulsation of the torque, variations in the speed of the carriage are large, thereby disturbing the picture quality.

SUMMARY OF THE INVENTION

The present invention has been made in consideration of the above-described problems.

It is an object of the present invention to provide an ink-jet recording apparatus capable of improving stability of the speed of a carriage, and realizing a servo system having an excellent acceleration property without increasing the production cost.

According to one aspect of the present invention, an ink-jet recording apparatus for performing recording by discharging ink from recording means onto a recording medium includes a carriage adapted to convey a recording head, a conveying member adapted to drive the carriage using a belt stretched between pulleys connected to corresponding ones of two motors, and a motor driving circuit adapted to drive the two motors, having first-phase and second-phase output stages, each obtained by performing complementary connection of a pair of transistors via a resistor, in which one of the motors is connected from a high-voltage terminal of a resistor of the first-phase output stage to a low-voltage terminal of a resistor of the second-phase output stage, and another motor is connected from a low-voltage terminal of the resistor of the first-phase output stage to a high-voltage terminal of the resistor of the second-phase output stage.

According to another aspect of the present invention, a recording apparatus for performing recording by discharging ink from recording means onto a recording medium includes a carriage adapted to convey a recording head, and a conveying member adapted to drive the carriage using a belt stretched between pulleys connected to corresponding ones of two motors. A driving force for the carriage by the two motors is differently distributed.

The foregoing and other objects, advantages and features of the present invention will become more apparent from the following description of the preferred embodiment taken in conjunction with the accompanying drawings.

BRIEF DESCRIPTION OF THE DRAWINGS

FIG. 6 is a diagram illustrating control of the power supply means shown in FIG. 1;

DESCRIPTION OF THE PREFERRED EMBODIMENT

A preferred embodiment of the present invention will now be described with reference to the drawings.

Figure 2:
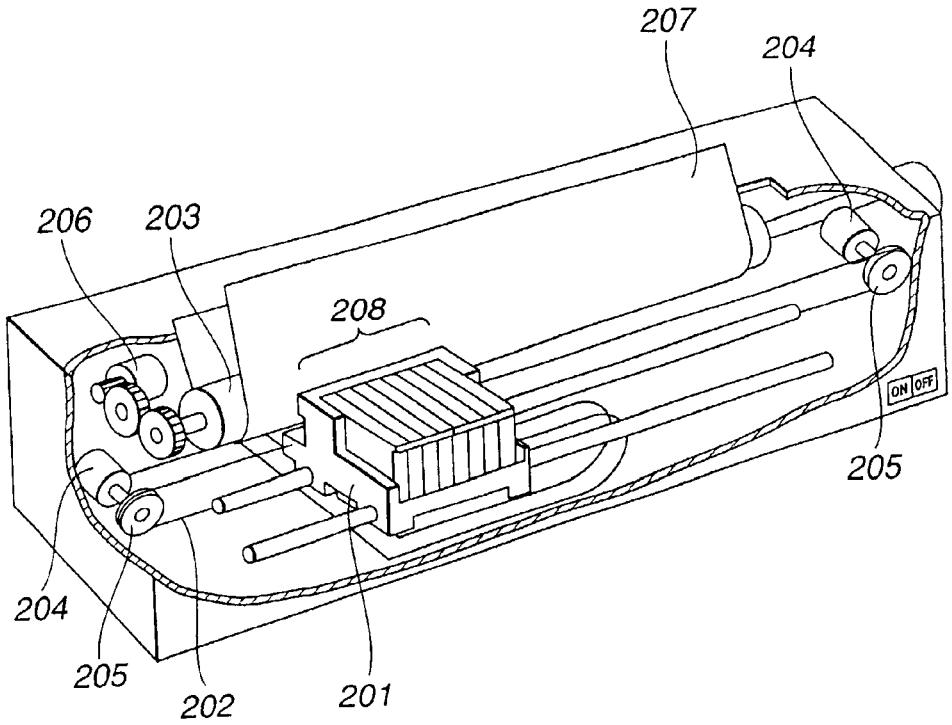
FIG. 2 is a schematic diagram illustrating the configuration of a recording apparatus according to the embodiment.

FIG. 2 is a schematic diagram illustrating the configuration of a recording apparatus according to the embodiment. In FIG. 2, a carriage 201 mounting a head 208 is caused to perform scanning by a belt 202. Two pulleys 205 are rotated by two corresponding DC motors 204 positioned at both end portions of the apparatus. Recording paper 207, serving as a recording medium, is conveyed by rotating a platen 203 by the driving force of a motor 206.

Figure 4:
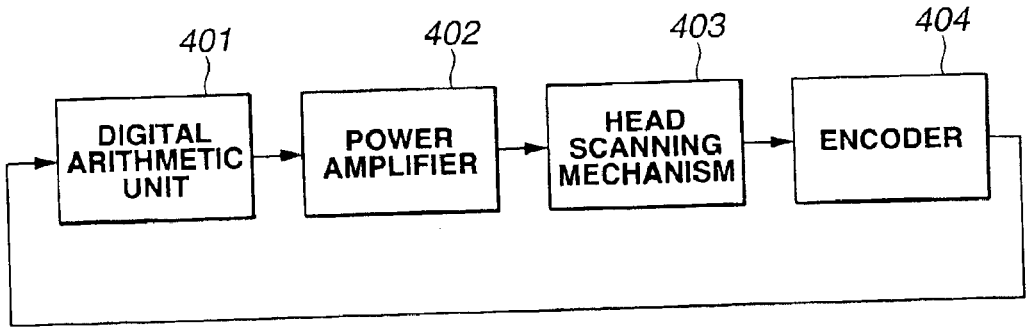
FIG. 4 is a block diagram illustrating the configuration of control in the embodiment.
Figure 5A:
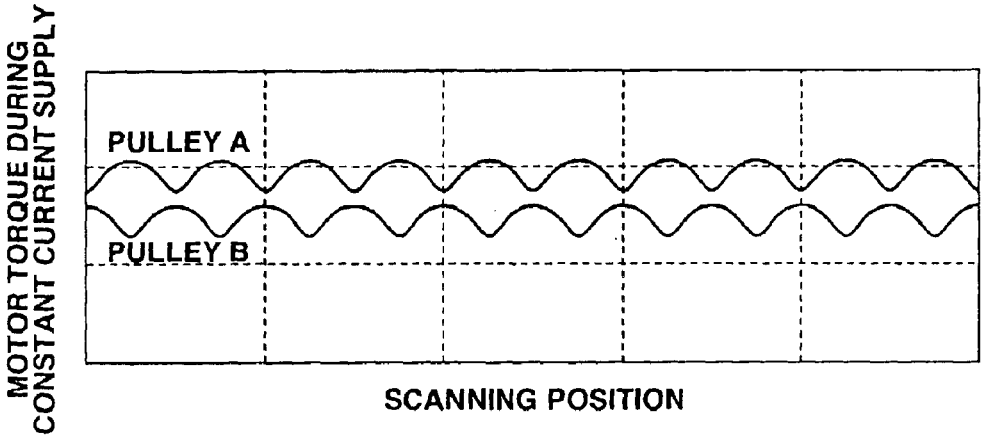
FIGS. 5A and 5B are graphs illustrating motor control in the embodiment.
Figure 5B:
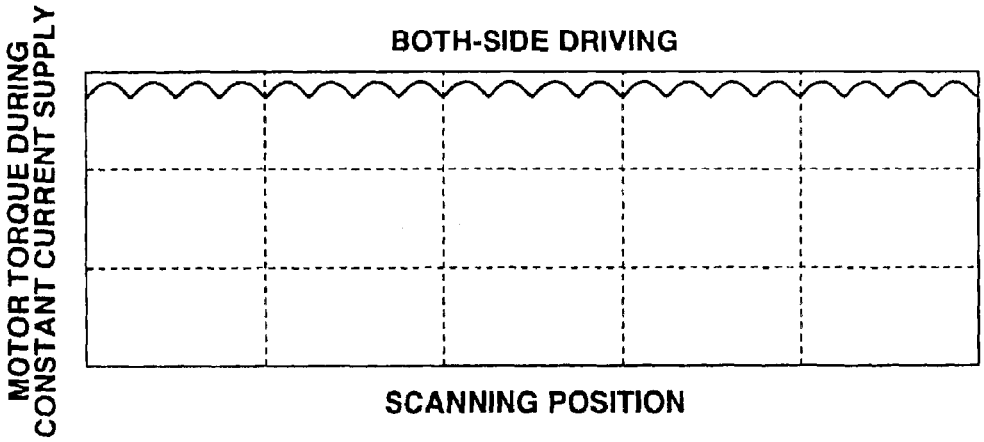
Figure 7:
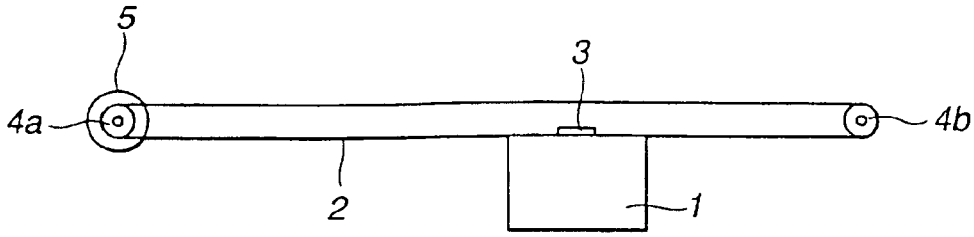
FIG.7 PRIOR ART
FIGS. 7 and 8 are diagrams illustrating a conventional configuration.
Figure 8:
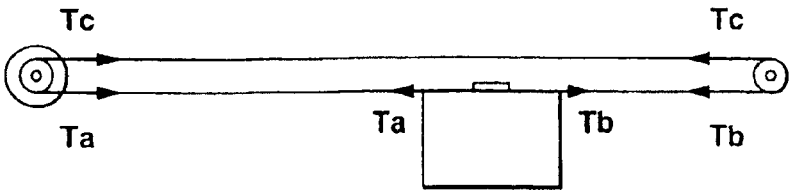
FIG.8 PRIOR ART
Figure 9:
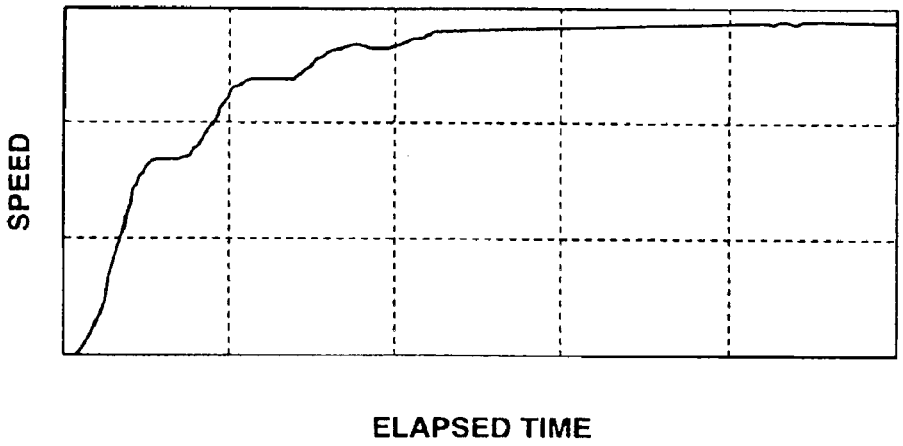
FIG.9 PRIOR ART
FIG. 9 is a graph illustrating vibration during acceleration of a carriage.

FIG. 4 is a schematic block diagram illustrating the configuration and flow of control of the recording apparatus. The carriage 201 mounting the head 208 is controlled by a head scanning mechanism 403. The state of scanning (position information) of the head 208 is read by an encoder 404. A power amplifier 402, serving as a driving source, is controlled based on a result of calculation by a digital arithmetic unit 401. The rotors of the two motors 204 are connected by toothed belts and the pulleys without producing a slip. The relative positional relationship between the magnetic poles and phase excitation of the rotors may be fixedly connected at an angle obtained by dividing 180 degrees by the number of poles of the motor and the total number of excitations.

Figure 3A:
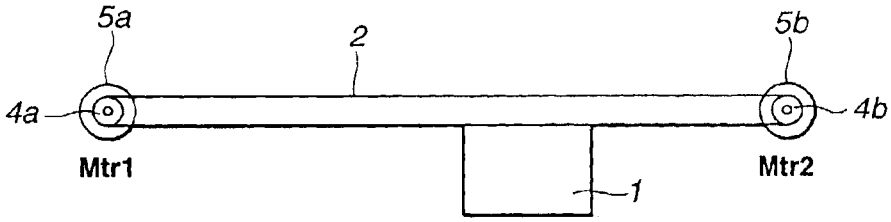
FIGS. 3A and 3B are a top plan view and a side view, respectively, illustrating the configuration of part of the apparatus shown in FIG. 2.
Figure 3B:
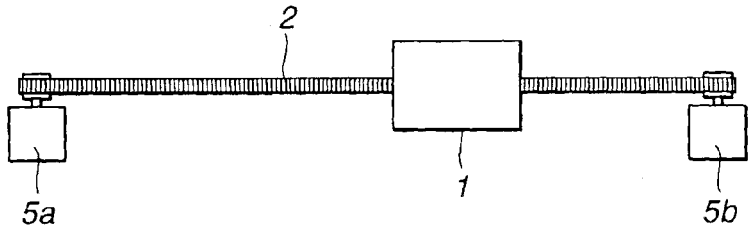

The feature of the configuration of the apparatus compared with the conventional configuration of head feeding by belt driving is in that, as shown in the configuration of the apparatus in FIG. 2, the two DC motors 204 for driving the two corresponding pulleys are provided. FIGS. 3A and 3B illustrate the configuration of conveyance of a carriage 1. DC motors 5*a* and 5*b* are coaxially connected to pulleys 4*a* and 4*b*, respectively, and the driving force of each of these motors 5*a* and 5*b* is transmitted to the carriage 1 via a conveyance belt 2.

Figure 1:
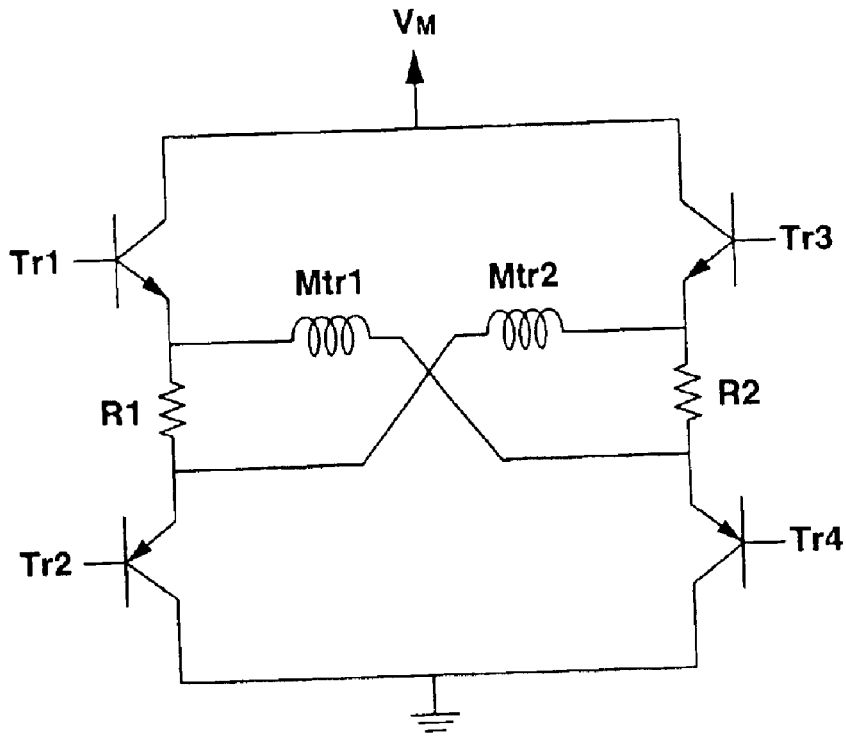
FIG. 1 is a diagram illustrating the circuit configuration of power supply means according to an embodiment of the present invention.

FIG. 1 illustrates a driving circuit for the motors, and particularly, a portion of power amplification of power supply means. This portion corresponds to the configuration of the power amplifier 402 shown in FIG. 4. This power supply means performs power control with two push-pull systems comprising four transistors Tr1, Tr2, Tr3 and Tr4, and connects two DC motors Mtr1 and Mtr2 as loads.

The collector of each of the source-side transistors T1 and Tr3 is connected to a power supply $V_M$, and the collector of each of the sink-side transistors Tr2 and Tr4 is connected to a negative power supply or the ground. Although, in this embodiment, bipolar transistors are illustrated, FET's (field-effect transistors) may also be used without changing the essence of the invention.

A complementary pair comprising the source-side transistor Tr1 and the sink-side transistor Tr2 are connected via a resistor R1. Another complementary pair comprising the source-side transistor Tr3 and the sink-side transistor Tr4 are connected via a resistor R2. The positive terminal and the negative terminal of the first DC motor Mtr1 are connected to a portion between the transistor Tr1 and the resistor R1, i.e., to the emitter of the transistor Tr1, and to a portion between the resistor R2 and the transistor Tr4, i.e., to the emitter of the transistor Tr4, respectively. The positive terminal and the negative terminal of the second DC motor Mtr2 are connected to a portion between the resistor R1 and the transistor Tr2, i.e., to the emitter of the transistor Tr2, and to a portion between the transistor Tr3 and the resistor R2, i.e., to the emitter of the transistor Tr3, respectively.

In the foregoing description, the positive terminal and the negative terminal of each of the DC motors Mtr1 and Mtr2 are clearly defined, in order to mechanically limit the direction of rotation of each of the motors. That is, in certain current supply logic, the two motors are arranged to generate respective torques in the same direction. It is assumed that, in FIG. 2, each of the motors rotates in a direction CW when current is supplied in a positive direction, and the carriage is moved to the left in the main scanning direction.

It is assumed that in a forward direction, Tr1=Tr4=ON, and Tr3=Tr2=OFF. As shown in FIG. 2, current is supplied to the motor Mtr1 in a positive direction by the ON operation of the transistors Tr1 and Tr4, and the motor Mtr1 rotates in the CW direction. In the motor Mtr2, since current flows from the power supply via the transistor Tr1, the resistor R1, the motor Mtr2, the resistor R2 and the transistor Tr4, the motor Mtr2 rotates in the CW direction as does the motor Mtr1.

However, the amount of current flow through the motor Mtr2 is smaller by being limited by the resistors R1 and R2. In this case, the motor Mtr1 operates as a main power source of traction of the carriage, and the motor Mtr2 has a role of preventing sagging of the belt or removing the component of vibration of the belt.

When performing a braking operation, Tr2=Tr4=OFF, and Tr1=Tr3=ON. FIG. 6 illustrates the relationship between ON/OFF of the transistors and driving modes.

The values of the resistors R1 and R2 must be determined relative to the inter-terminal resistance of the motor. That is, when the inter-terminal resistance of each of the motors Mtr1 and Mtr2 is substantially Ra, R1=R2=k• Ra, where k is a dimensionless coefficient. For example, if k=1, a DC current is distributed to the two motors with a ratio of 3:1. A configuration may also be adopted in which distribution of the driving force is changed by adjusting the ratio k.

The above-described recording apparatus of the invention can be applied to an ink-jet recording apparatus for performing recording by discharging ink, and more preferably, to a bubble-jet recording apparatus for discharging ink using heat.

As is apparent from the foregoing description, according to the present invention, a symmetrical operation is realized in two-way movement. Accordingly, excellent two-way recording can be performed, fluctuation of the tension of a belt is small, influence by pulsation of a torque is prevented, and stability in the speed of a carriage is improved.

Furthermore, since two motors can be driven by one set of control means and power supply means as in the conventional system, a servo system having an excellent acceleration property can be realized without increasing the production cost.

The individual components shown in outline or designated by blocks in the drawings are all well-known in the printing apparatus arts and their specific construction and operation are not critical to the operation or the best mode for carrying out the invention.

While the present invention has been described with respect to what is presently considered to be the preferred embodiment, it is to be understood that the invention is not limited to the disclosed embodiment. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink-jet recording apparatus for performing recording by discharging ink from recording means onto a recording medium, said apparatus comprising:

a carriage adapted to convey a recording head;

a conveying member adapted to drive said carriage using a belt stretched between two pulleys;

a first motor connected to one of the pulleys and a second motor connected to the other of the pulleys as drive sources of said two pulleys; and a drive circuit for driving said first motor and said second motor after receiving power supply from a source, wherein said drive circuit:

push-pull-connects a first transistor and a fourth transistor, and connects said first motor between said first transistor and said fourth transistor, push-pull-connects a second transistor and a third transistor, and connects said second motor between said second transistor and said third transistor, connects a connection point between said first transistor and said first motor with one terminal of first resistance, and connects a connection point between said second transistor and said second motor with the other terminal of said first resistance, connects a connection point between said third transistor and said second motor with one terminal of second resistance, and connects a connection point between said fourth transistor and said first motor with the other terminal of said second resistance, and connects said first transistor and said third transistor with said source.

2. An apparatus according to claim 1, wherein a rotor of said first motor and a rotor of said second motor are connected by a synchronous belt and said two pulleys, respectively, without slip, and a relative positioning relation of torque between said first motor and said second motor is shifted by 180 degrees.

3. An apparatus according to claim 1, wherein a difference in torque between said first motor and said second motor is based on the value of said first resistance and the value of said second resistance.

4. An apparatus according to claim 1, wherein said drive circuit further comprises control means for turning on said first transistor and said fourth transistor and turning off said second transistor and said third transistor when said first motor and said second motor are driven in one direction, and for turning off said first transistor and said fourth transistor and turning on said second transistor and said third transistor when said first motor and said second motor are driven in the other direction.

5. An apparatus according to claim 1, wherein said first transistor, said third transistor, said second transistor and said fourth transistor are bipolar transistors or field-effect transistors.

6. A recording apparatus for performing recording by discharging ink from recording means onto a recording medium, said apparatus comprising:

a carriage adapted to convey a recording head; and a conveying member adapted to drive said carriage using a belt stretched between pulleys respectively connected to first and second motors, wherein, among said two motors, a driving force of one of said first and second motors for driving one of said pulleys is greater than that of the other of said first and second motors for driving the other of said pulleys.

7. An apparatus according to claim 6, wherein the driving force of said first motor is greater than that of said second motor when said carriage moves in one direction, and the driving force of said second motor is greater than that of said first motor when said carriage moves in the opposite direction.

8. An ink-jet recording apparatus for performing recording by discharging ink from recording means onto a recording medium, said apparatus comprising:

a carriage adapted to convey a recording head;

a conveying member adapted to drive said carriage using a belt stretched between two pulleys;

a first motor connected to one of said pulleys and a second motor connected to the other of said pulleys as drive sources of said two pulleys; and a drive circuit for driving said first motor and said second motor after receiving power supply from a source, wherein said drive circuit:

connects a first transistor of an NPN type and a fourth transistor of a PNP type through said first motor, and connects a third transistor of the NPN type and a second transistor of the PNP type through said second motor, connects a first resistance between said first transistor and said second transistor, and connects a second resistance between said third transistor and said fourth transistor, and connects a collector of said first transistor and a collector of said third transistor with said source.

9. A recording apparatus for performing recording by discharging ink from recording means onto a recording medium, said apparatus comprising:

a carriage adapted to convey a recording head;

a conveying member adapted to drive said carriage using a belt stretched between pulleys respectively connected to first and second motors; and controlling means for controlling driving forces so that, among said first and second motors, when moving said carriage, a driving force of one of said first and second motors for driving one of said pulleys is greater than that of the other of said first and second motors for driving the other of said pulleys.

10. A recording apparatus according to claim 9, wherein said controlling means controls the driving forces based on a moving direction of said carriage.

11. An ink-jet recording apparatus for performing recording by discharging ink from recording means onto a recording medium, said apparatus comprising:

a carriage adapted to convey a recording head;

a conveying member adapted to drive said carriage using a belt stretched between two pulleys;

a first motor connected to one of said pulleys and a second motor connected to the other of said pulleys as drive sources of said two pulleys; and controlling means for controlling driving forces so that, when said carriage is moved in a direction toward the one of said pulleys, a driving force of said first motor is greater than that of said second motor and when said carriage is moved in a direction toward the other of said pulleys, a driving force of said second motor is greater than that of said first motor.

* * * * *